United States Patent [19]

Wisniewski

[11] Patent Number: 4,653,207

[45] Date of Patent: Mar. 31, 1987

[54] PHOTO FRAME ASSEMBLY

[75] Inventor: John J. Wisniewski, W. Chatham, Mass.

[73] Assignee: J & K Sales Co., Inc., Pawtucket, R.I.

[21] Appl. No.: 791,534

[22] Filed: Oct. 25, 1985

[51] Int. Cl.[4] ..... A47G 1/06; G09F 1/12

[52] U.S. Cl. ..... 40/156; 40/152; 40/530

[58] Field of Search ..... 40/152, 152.1, 156, 40/530; D6/300

[56] References Cited

U.S. PATENT DOCUMENTS

| | | | |
|---|---|---|---|
| Re. 26,395 | 5/1968 | Schneider | 40/530 |
| 1,366,432 | 1/1921 | Summer | 40/156 |
| 3,529,374 | 9/1970 | Spertus | 40/152 |
| 4,356,652 | 11/1982 | Schneider | 40/530 |

FOREIGN PATENT DOCUMENTS

| | | | |
|---|---|---|---|
| 528754 | 5/1954 | Belgium | 40/152 |

*Primary Examiner*—Gene Mancene
*Assistant Examiner*—J. Hakomaki
*Attorney, Agent, or Firm*—Barlow & Barlow, Ltd.

[57] ABSTRACT

A picture frame assembly has a hinged two part tray-like member with a unitary two part molded mat that snaps into the members and has a joining strip between the two mat sections that overlies the hinge.

4 Claims, 5 Drawing Figures

PHOTO FRAME ASSEMBLY

BACKGROUND OF THE INVENTION

Picture frames have generally relied upon a flat picture mat for providing an overlay border around the periphery of the picture mounted in the frame. In lieu of mats, three dimensional framing materials have been suggested as seen in the Smith et al patent, U.S. Pat. No. 3,371,439 and another form in the Leonhardt patent, U.S. Pat. No. 3,787,992. In two part hinged boxes, it has been the pratice to cover the inside of the boxes with a covering that extended from one box to the other and two individual mats. It is desirable in a picture frame assembly to have a unit which may be quickly assembled by the user which is pleasing in appearance and which utilizes a minimum number of parts. This is achieved in a folding picture frame assembly that may contain two photographs by utilizing a simple two part folding box and a unitary mat.

SUMMARY OF THE INVENTION

A picture frame assembly is provided which utilizes a rigid two part tray-like box, which is hinged together so that the two trays in folded position will close upon each other. The hinge structure is not decorative and must be covered in order to make the picture frame assembly attractive. To this end, a integral picture frame is detachably secured in each part of the tray-like box and is provided with peripheral ridges which snap into the tray like box, the two frames being joined together by a flexible strip which overlies the hinge and achieves a decorative, simple two part structure.

It is, therefore, the principal object of this invention to provide a picture frame assembly wherein the picture frame or mat member includes peripheral walls that will snap into the tray like box or structure and which picture frames or mat members are joined together along one edge with a decorative portion that will overlie the hinging arrangment of the two part tray-like box.

DESCRIPTION OF THE PREFERRED EMBODIMENT

Figure 1:
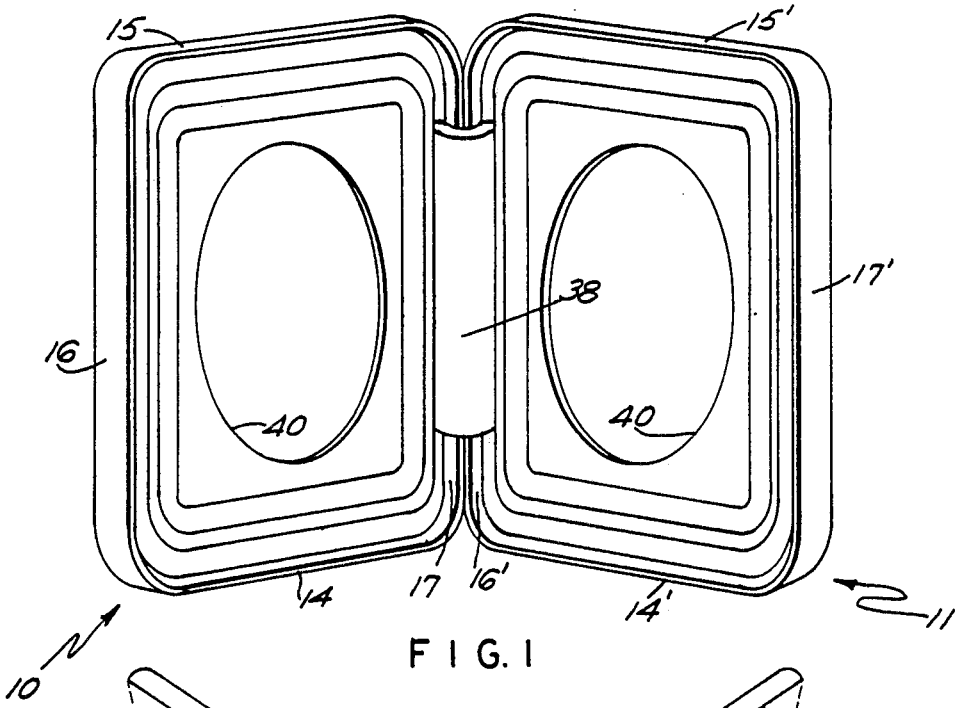
FIG. 1 is a perspective view of a picture frame assembly made in accordance with the invention.
Figure 2:
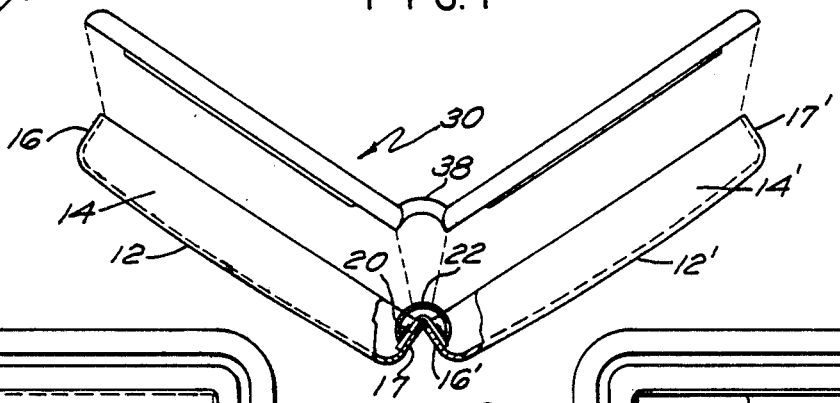
FIG. 2 is a bottom elevation view thereof partly in section;.

As illustrated in FIG. 1, the picture frame assembly includes a pair of tray-like members or boxes, generally designated 10 and 11, which each consist of bottom walls 12, 12', end walls 14, 15, 14', 15', and side walls 16, 17, 16', 17'. The side walls 17 and 16' are joined together by a hinge 20, substantially of the type shown in the Rhodes patent, U.S. Pat. No. 1,626,301, with the hinge axis being parallel to the side walls 17, 16'. The hinge is constructed to receive hooked ends of a leaf spring 22 as seen in FIG. 2 and operates as known to those skilled in the art so that the box will maintain itself in a closed position or in an open position as seen in the drawings.

To present a pleasing appearance, the tray-like members 10 and 11 may be suitably covered about their outer extent with any material so that an attractive appearance is had.

Figure 3:
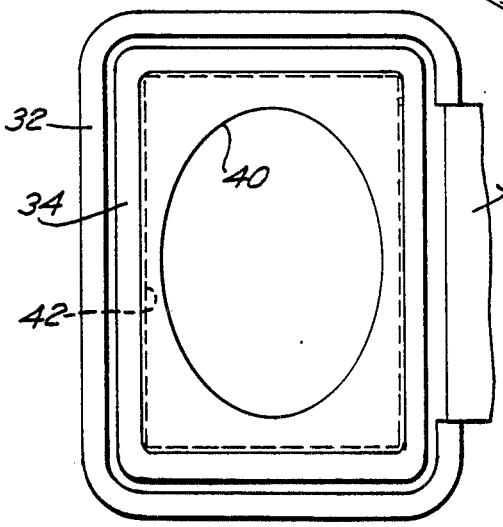
FIGS. 3 and 4 are plan views of two forms of picture frame mats that may be used with the invention.
Figure 4:
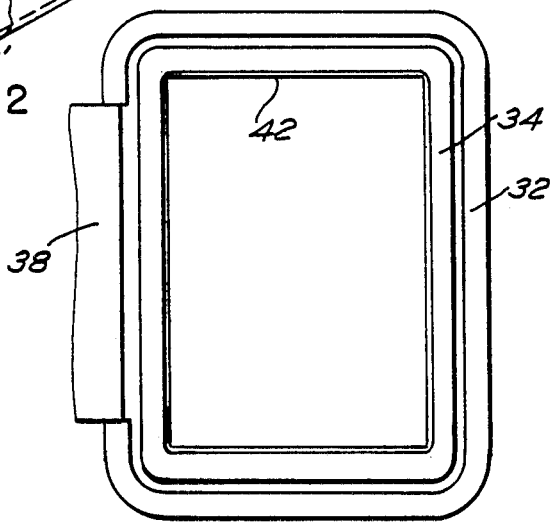
Figure 5:
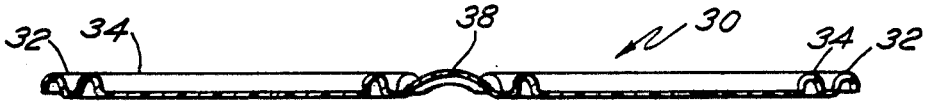
FIG. 5 is a sectional view taken through the central portion of the mat showing the manner in which the mat is molded so that it will snap into place and be retained in the tray-like box.

A mat 30 consists of a unitary molded part, the construction of which is seen best in FIG. 5. As seen in FIG. 5, the mat has a pair of peripheral ridges 32, 34 which are molded about the edge of the mat, the ridges defining border walls or frames. Besides presenting a pleasing appearance, the ridges maintain a certain lateral spring action and are molded in such a way that they need to be snapped into the interior of the tray-like members so that they will engage in gripping fashion the side and end walls of the members. Also as seen in FIG. 5, the two mats sections are joined by a central web 38, which has substantial longitudinal extent of a sufficient nature to overlie the entire hinge structure consisting of the hinge 20 and the spring 22. The mat may have various cut out sections depending upon the asthenic appearance desired, and this end as seen in FIG. 3, a central cut out 40 may be of oval shape or, as seen in FIG. 4, the cut out 42 may be rectangular.

I claim:

1. A picture frame assembly comprising a rigid two part box having two identical rectangular open tray-like members having a bottom and side walls with the open top edges of the side walls normally abutting, a hinge pivotally connecting one edge of abutting portions of the box parts, a pair of integral picture frame mats detachably secured in each part of the box and being joined together by an integral flexible strip, each of said mats corresponding in shape to the shape of the open top members and having central openings and a peripheral ridge, said flexible strip overlying the hinge and the juxtaposed side walls.

2. An assembly as in claim 1 wherein a C-shaped spring acts on the hinge.

3. As assembly in claim 1 wherein the peripheral ridge on the mats exerts an outward gripping force securing the mats in the box.

4. A picture frame assembly comprising a rigid two part box having two identical rectangular open tray-like members having a bottom and side walls with the open top edges of the side walls normally abutting, a hinge pivotally connecting one edge of abutting portions of the box parts, a unitary picture frame having two mats joined together by a flexible strip, each mat having a peripheral ridge and a cut-out and each mat insertable into the tray-like members of the two-part box, said flexible strip overlying the hinge between the box parts.

* * * * *